United States Patent [19]

Nurmi et al.

[11] 4,430,880

[45] Feb. 14, 1984

[54] DEVICE FOR STRAIGHTENING SUSPENSION BARS REMOVED FROM THE CATHODE PLATES IN ELECTROLYTIC REFINING PLANTS

[75] Inventors: Jarkko Nurmi, Vermuntila; Leo Uusitalo, Tampere, both of Finland

[73] Assignee: Outokumpu Oy, Helsinki, Finland

[21] Appl. No.: 255,276

[22] Filed: Apr. 17, 1981

[30] Foreign Application Priority Data

Apr. 21, 1980 [FI] Finland ..... 801276

[51] Int. Cl.[3] ..... B21J 7/14; B21D 31/06

[52] U.S. Cl. ..... 72/400; 72/411

[58] Field of Search ..... 72/403, 399, 400, 420, 72/411, 427; 100/232, 249

[56] References Cited

U.S. PATENT DOCUMENTS

| | | | |
|---|---|---|---|
| 2,985,101 | 5/1961 | Hillstrom | 100/249 |
| 3,185,186 | 5/1965 | Kinser et al. | 72/399 |
| 3,696,656 | 10/1972 | Nara et al. | 72/420 |

*Primary Examiner*—Nicholas P. Godici
*Assistant Examiner*—Peter B. Martine
*Attorney, Agent, or Firm*—Brooks, Haidt, Haffner & Delahunty

[57] ABSTRACT

An apparatus for straightening suspension bars removed from cathode plates includes a horizontal press, a vertical press, a vertically movable stop plate, and an ejector in the horizontal press. The horizontal press pushes the suspension bar against the stop plate when the stop plate is in its upper position, and ejects the straightened suspension bar laterally when the stop late is in its lower position.

4 Claims, 3 Drawing Figures

DEVICE FOR STRAIGHTENING SUSPENSION BARS REMOVED FROM THE CATHODE PLATES IN ELECTROLYTIC REFINING PLANTS

BACKGROUND OF THE INVENTION

The present invention relates to apparatus for straightening suspension bars removed from cathode plates in electrolytic refining plants.

In the electrolytic refining of metals, e.g. copper, the starting sheets are fixed to suspension bars. Supported by the suspension bars, the starting sheets are transferred into the electrolytic tanks, and the starting sheets are allowed to grow into cathode plates. The completed cathode plates are lifted by the suspension bars and transferred to the cathode-plate bundling machine. During the bundling of the cathode plates, the suspension bars are removed from the cathode plates, and the removed suspension bars are transferred to an intermediate storage, and then re-used in starting sheets.

In order to decrease the large amount of capital tied up in suspension bars made of copper, the suspension bars are made as lightweight as possible. However, this results in a disadvantage, namely, that the strength of the lightweight suspension bars against incidental blows or impacts during lifting and other work stages is not always sufficient. Therefore, in practice nearly all suspension bars are bent more or less in either the vertical or the lateral direction.

Suspension bars which have been bent too much cause difficulties during all stages of handling. Since the speed of currently used automatic mechanicms is only a few seconds per bar and sheet, even the shortest stoppage results in a considerable loss in capacity. Likewise, the risk of machine breakage is always evident in the case of a disturbance.

Attempts have been made to find a suitable method for straightening the suspension bars. Suspension bars have been straightened by, for example, taking aside some of the suspension bars which are in circulation and by straightening them by using a separate press or by striking or by some other method. This, however, requires individual checking of the suspension bars and results in an entire separate work stage, in which the amount of manual work is high. Furthermore, such procedure keeps some of the suspension bars out of the suspension-bar cycle.

The object of the invention is to provide an improvement to the prior known practices. A more specific objective of the invention is to provide a means by which the suspension bars removed from cathode plates can be straightened in such a manner that a batch of suspension bars need not be taken out of the cycle of the suspension bars. A further object of the invention is to provide apparatus in which the suspension bars can be straightened in such a manner that the straightening of the suspension bars does not constitute an entire separate work stage in which the amount of manual work is high. A further object of the invention is to provide means for a method in which the straightening of the suspension bars is linked in a natural manner to the bundling of the suspension bars. The other objects of the invention and the advantages thereby gained are disclosed in the specification of the invention.

SUMMARY OF THE INVENTION

The present invention provides a method which comprises the following steps:

(a) the suspension bars removed from the cathode plates are transferred to the straightening station, which is provided with a straightening apparatus, (b) the suspension bars are straightened by pressing, by means of the straightening apparatus, each suspension bar in stages and substantially simultaneously in both the vertical and the lateral directions, and (c) the straightened suspension bar is transferred in the lateral direction by the straightening apparatus and a suspension-bar bundle is formed from the straightened suspension bars on a chain conveyor, in a crate, in a cassette, or suchlike.

The present invention also provides an apparatus for carrying out the method according to the invention, which apparatus comprises:

(a) a frame;

(b) a vertical press device, which is fitted to press the suspension bar in the vertical direction, and a horizontal press device, which is fitted to press the suspension bar in the lateral direction;

(c) a drive device which is fitted to drive the said vertical press device and a drive device which is fitted to drive the said horizontal press device, and (d) a removing device, which is fitted to transfer the straightened suspension bar in the lateral direction.

Numerous significant advantages are gained using the method and apparatus according to the invention. In the method according to the invention, the suspension bars removed from the cathode plates are straightened automatically at the straightening station, which is located as a part of the transfer track for the suspension bars removed from the cathode plates. In the method according to the invention, the suspension bars travel along the removal track for suspension bars, and the suspension bars are straightened by pressing a suspension bar in stages and simultaneously in both the vertical and the lateral direction. In the method according to the invention, the straightening apparatus for suspension bars ejects the straightened suspension bar in the lateral direction and forms a bundle of bars, for example on a chain conveyor, in a crate or in a cassette. In the method according to the invention, the straightening functions can be used in a controlled manner according to need, i.e. when the suspension bars have deflections to a disturbing degree. At other times the straightening apparatus in the method according to the invention serves only as a bundling device for suspension bars.

DESCRIPTION OF THE PREFERRED EMBODIMENT

Figure 1:
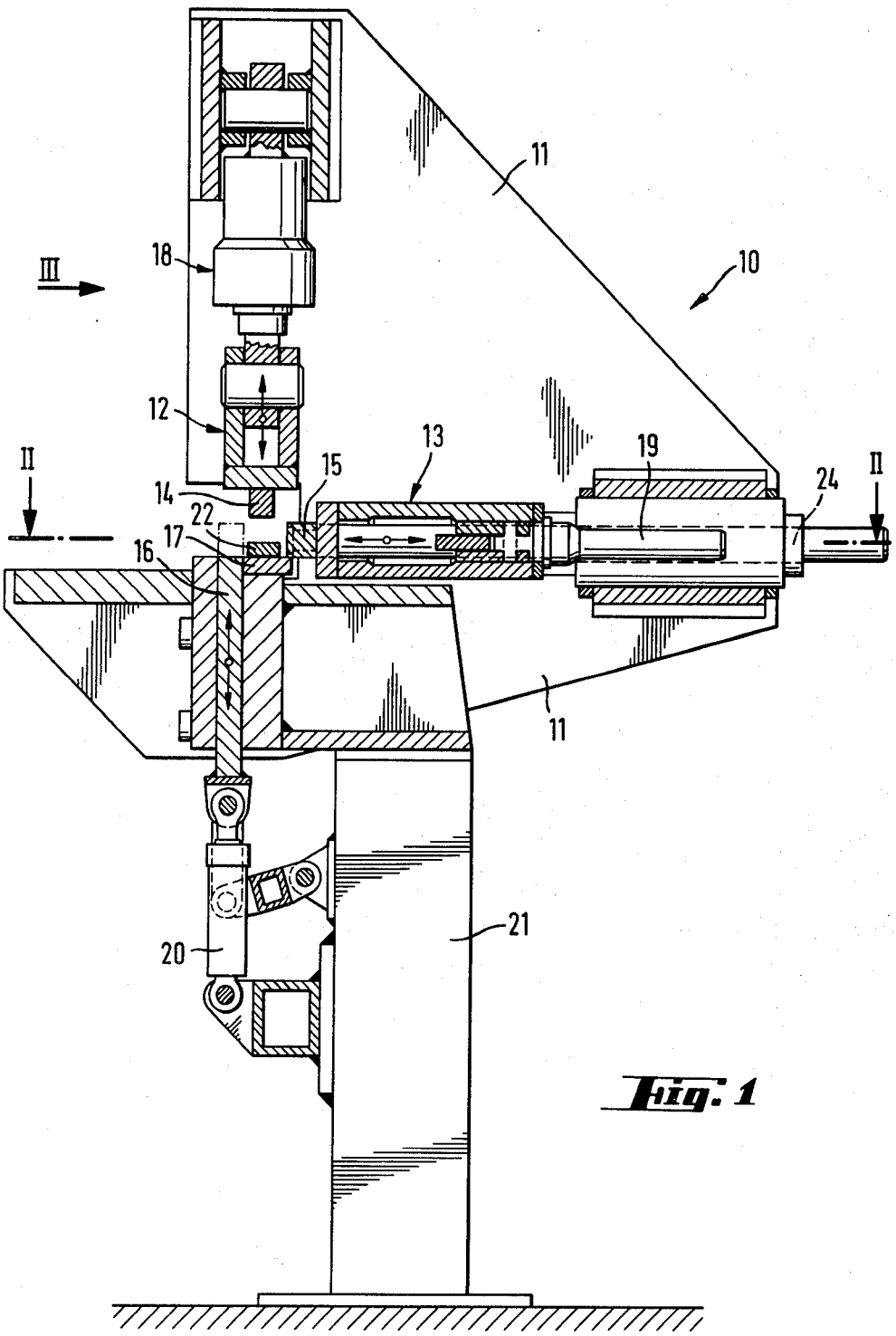
FIG. 1 depicts a side elevation, partly in section, of a preferred embodiment of the apparatus intended for carrying out the method according to the invention.
Figure 2:
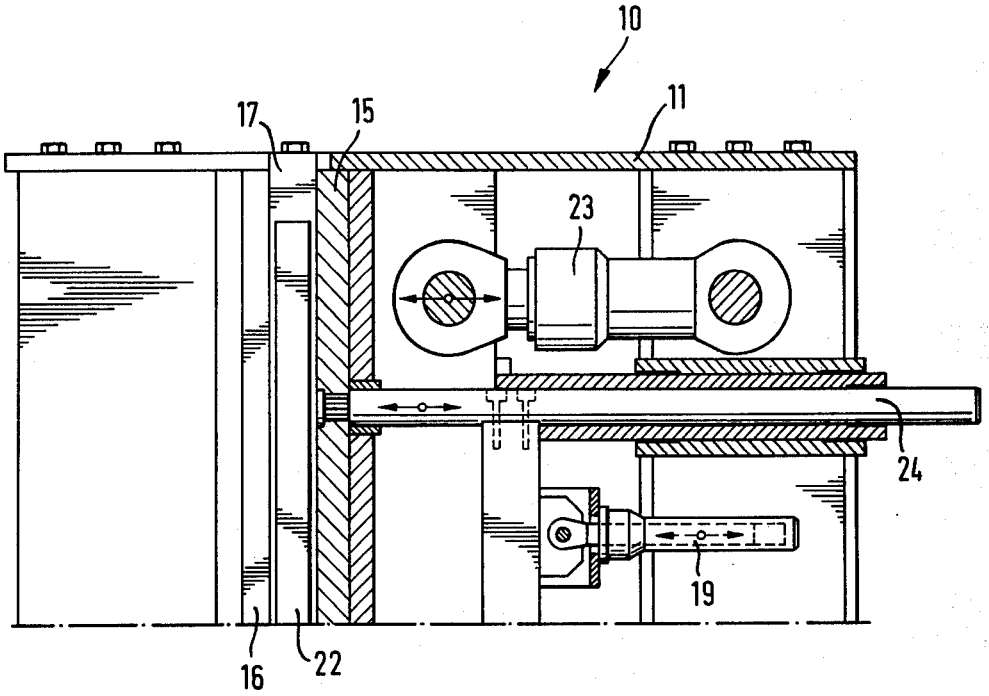
FIG. 2 depicts a plan view of the apparatus according to FIG. 1.
Figure 3:
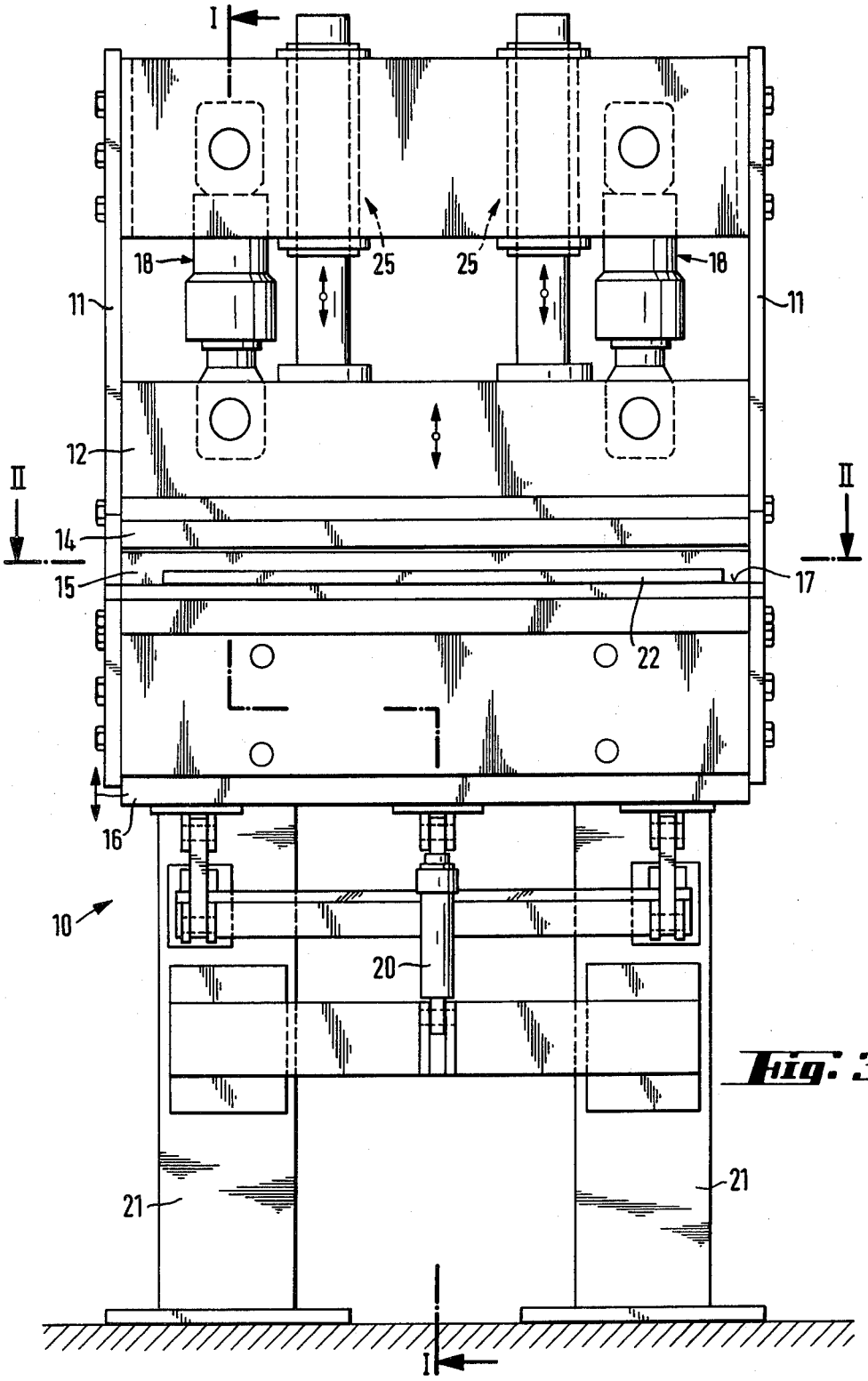
FIG. 3 depicts a front view of the apparatus according to FIG. 1.

In the embodiment according to FIGS. 1–3, the apparatus intended for carrying out the method according to the invention is in general indicated by reference numeral 10. The apparatus 10 comprises a frame part 11 and press devices 12 and respectively 13, guided by leads 24 and 25, the press device 12 being a vertical press device, and respectively the press device 13 being a horizontal press device. The pressing rail of the vertical press device 12 is indicated by 14 and respectively the ejector of the horizontal press device 13 is indicated by 15. The straightening apparatus 10 according to the invention also comprises a stop plate 16 and a bottom stop 17. The stop plate 16 is fitted to move in the vertical direction, and the stop plate 16 is in its upper position when the supporting bar 22 arrives at the straightening apparatus 10. The horizontal press device 13 is fitted to press the suspension bar 22 against the stop plate 16, and respectively the vertical press device 12 is fitted to press the suspension bar 22 against the bottom stop 17.

The drive device 18, e.g. a hydraulic cylinder, is fitted to drive the vertical press device 12. Respectively the drive device 23, e.g. a hydraulic cylinder, is fitted to drive the horizontal press device 13. The hydraulic cylinder 19 is attached to the horizontal press device 13, from which the hydraulic cylinder, for example via leads 24, moves the ejector 15. Respectively, the drive device 20, e.g. a hydraulic cylinder, is fitted to move the stop plate 16. Reference numeral 21 indicates the support legs of the straightening apparatus 10 according to the invention.

The pressing rail 14, the ejector 15 and the bottom stop 17 of the vertical press device 12 can be replaced to accommodate suspension bars 22 of different shapes or for other reasons.

The straightening method according to the invention is as follows. The suspension bars 22 are straightened automatically at a straightening station which has a straightening apparatus 10 according to the invention, the straightening station being located as a part of the transfer track for the suspension bars 22 removed from the cathode plates. The suspension bar 22 arrives at the straightening apparatus 10, moving longitudinally along the transfer track for suspension bars. The movement of the suspension bar 22 is stopped by means of a cushioning stop (not shown). The straightening apparatus 10 carries out the straightening by pressing the suspension bar 22 in stages and simultaneously in both the vertical and the lateral direction by means of a vertical press device 12 and respectively a horizontal press device 13. Thereafter, the ejector 15 of the straightening apparatus 10 ejects the suspension bar 22 in the lateral direction, and a suspension-bar bundle is formed from the straightened suspension bars, for example, on a chain conveyor, in a crate, or in a cassette. The straightening functions of the straightening apparatus 10 according to the invention can be used according to need, i.e. when the suspension bars 22 have deflections to a disturbing degree. At other times the straightening apparatus according to the invention serves only as a bundling device for suspension bars 22.

What is claimed is:

1. An apparatus for straightening suspension bars removed from cathode plates in an electrolytic refining plant which apparatus comprises means for conveying bars to a straightening station in a direction which is longitudinal with respect to the bars, a frame, a vertical press device, a horizontal press device and a drive device which is fitted to drive the horizontal press device, comprising a stop plate movable in the vertical direction and against which the said horizontal press device is fitted to press the suspension bar when the stop plate is in its upper position, and means for ejecting a straightened suspension bar laterally.

2. An apparatus according to claim 1, in which the drive means is fitted to move the stop plate in the vertical direction, and the stop plate is adapted to be in its upper position when the suspension bar enters the apparatus.

3. An apparatus according to claim 1, in which the ejecting means is an ejector in the horizontal press device.

4. An apparatus according to claim 3 in which the drive device fitted to drive the horizontal press device is fitted to move the ejector via leads.

* * * * *